US008245449B2

(12) United States Patent
Berdut Teruel

(10) Patent No.: US 8,245,449 B2
(45) Date of Patent: Aug. 21, 2012

(54) COMPRESSED FLUID BUILDING STRUCTURES

(76) Inventor: Elberto Berdut Teruel, San Juan, PR (US)

( * ) Notice: Subject to any disclaimer, the term of this patent is extended or adjusted under 35 U.S.C. 154(b) by 0 days.

(21) Appl. No.: 12/766,392

(22) Filed: Apr. 23, 2010

(65) Prior Publication Data

US 2011/0258940 A1 Oct. 27, 2011

(51) Int. Cl.
*E04B 1/34* (2006.01)
*E04C 3/34* (2006.01)

(52) U.S. Cl. ..... 52/2.11; 524/834

(58) Field of Classification Search ..... 52/2.11, 52/2.13, 2.21, 2.23, 301, 834; 405/289, 288, 405/229, 256; 248/354.1
See application file for complete search history.

(56) References Cited

U.S. PATENT DOCUMENTS 3,773,475 A * 11/1973 Madden, Jr. ..... 428/558
4,295,302 A * 10/1981 Liu ..... 52/2.21
4,685,253 A * 8/1987 Bitterly ..... 52/2.11
4,958,953 A * 9/1990 Charondiere ..... 403/297
5,117,606 A * 6/1992 Mikami ..... 52/834
5,339,594 A * 8/1994 Ventura-Berti ..... 52/834
5,533,309 A * 7/1996 Rivin ..... 52/223.8
5,546,707 A * 8/1996 Caruso ..... 52/2.13
5,555,678 A * 9/1996 Schoo ..... 52/2.13
5,735,083 A * 4/1998 Brown et al. ..... 52/2.13
6,484,469 B2 * 11/2002 Drake ..... 52/649.2
7,232,103 B2 * 6/2007 Heath ..... 248/631
7,293,412 B2 * 11/2007 Fuchs ..... 60/512
2002/0157322 A1 * 10/2002 Pedretti ..... 52/2.13
2004/0000118 A1 * 1/2004 Fuerle ..... 52/737.4
2004/0074150 A1 * 4/2004 Wycech ..... 52/2.13
2006/0059788 A1 * 3/2006 Kassianoff ..... 52/2.11
2006/0242925 A1 * 11/2006 Koerner ..... 52/721.4
2009/0019784 A1 * 1/2009 Tinker et al. ..... 52/2.11
2009/0095366 A1 * 4/2009 Gray, Jr. ..... 138/30
2010/0163683 A1 * 7/2010 Quine ..... 244/158.5
2011/0047886 A1 * 3/2011 Welch et al. ..... 52/2.21

* cited by examiner

*Primary Examiner* — Christine T Cajilig
(74) *Attorney, Agent, or Firm* — Luis Figarella

(57) ABSTRACT

The compressive strength of a fluid-pressurized structure is combined with the tensile strength of interior members to maintain the geometric shape of a structure used to provide support with very low mass. These compressed fluid building structures can be combined with other traditional construction materials in creating columns, beams and other structural support elements.

15 Claims, 5 Drawing Sheets

COMPRESSED FLUID BUILDING STRUCTURES

TECHNICAL FIELD

The present invention generally relates to load bearing structures using a fluid as a compression structural member, more particularly to the combination of said members with tensile elements to provide for structural integrity.

BACKGROUND

Since the invention of concrete with imbedded metal by Monier in 1849, load bearing structures have been built using a material with high compressive strength, embedded with a filament, wire or cable (collectively called the tensile members). In this fashion, most modern structures (bridges, columns, etc.) are built with a very large mass of concrete (mostly cement plus an aggregate), placed in tension via its own weight and the addition of said tensile members. Said large masses are required, for the tensile member would usually be worthless in the compressive mode.

Their structural mass (for in effect a bridge is many times heavier than its traffic payload) becomes at times a burden. As recent events in Haiti, Chile and China so aptly demonstrate, these same large masses have a sad and detrimental effect on the human population when natural phenomena such as earthquakes occur. Besides the amount of human lives that are loss during and shortly after the event, the significant amount of detritus created by these events causes the habitat around the disaster zone to be affected for years by the cost of its removal.

As seen in U.S. Pat. Nos. 3,854,253, 4,004,380, 4,676,032, 5,675,938 and 6,584,732, inflatable structures that have interior braces, cables, and films to maintain the geometry of the structure have been taught. These are not however, designed to be used in the construction of building blocks for larger structures, being in effect "fluffy" balloons. Between the connecting points of the cables to the outer surfaces, the outer surface material typically bulges out, due to the air pressure. If these were used as building blocks, when one block is placed upon another, the bulges would be springy and would compress so that there would not be sufficient rigidity for effective building blocks.

The above also includes use of the building blocks for the construction of convection towers, seen in U.S. Pat. Nos. 5,284,628; 5,395,598; 5,477,684; and 5,483,798; as well as US Pat. Appl. No. 20090260301 (all by Prueitt). They have in common the use of air compression blocks utilizing external tensile members to provide the tensile means. Drake (U.S. Pat. No. 6,484,469) utilizes moving pistons to perform some loading, but of course movement would require significant dynamic seal technology.

What is needed is a structure using a fluid (be it a gas, liquid or combination thereof) as the compression member, and either internal or external tensile means to help in keeping the compressed gas, liquid or combination thereof within an envelope or cavity, so that a relatively lightweight structural member may be produced for use in the construction of composite structural elements.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

Prior art structures utilizing fluids are mostly limited to utilizing air, and generally lack the rigidity associated by most with permanent structures. One purpose of the present invention is to combine the advantages of fluid compression in a composite assembly capable of being viewed, used, treated and deployed as a solid construction member.

In one embodiment of the invention, a column assembly for supporting a compressive load includes a combination of layers capable of containing a fluid under pressure within a cavity that is both impermeable and strong enough to prevent collapsing under load, when placed in a compressing position.

The column assembly also allows for the development of construction methods comprising the use of its various combinations in creating lighter, stronger and improved structures.

In one aspect, the invention relates to a column assembly having a sealed internal cavity surrounded and defined by an impermeable layer, with one or more fluids under pressure within said cavity; and one or more successive structural layers surrounding said impermeable layer, so as to provide structural integrity to the layer immediately within.

In an embodiment of the foregoing aspects, the compressed fluid is comprised substantially of air, or of substantially an inert gas, or it may be comprised substantially of water. In still another embodiment, cavity pressure sensing means are used to monitor the pressure and alert in situations where parameters are exceeded. Similarly, temperature sensing means may also be employed, as well as cavity pressure adjusting means. In one embodiment, the column assembly may be placed or attached to a mounting base.

In one embodiment, tension members run along the length of the compressed member securing the end caps to said compressed member. Said members may run either within the cavity and through the end caps, along the exterior surface of the column assembly, or within the walls making up the column assembly. In another embodiment, the column assembly's cavity is separated into connected sections via the addition of internal baffles to separate the sections. In one embodiment passive means are used to allow the passing of the fluid from one end to the other, whereas in another active means are used to contain (partially or totally) the fluid within their assigned cavities.

In one embodiment, the tension members run within the column assembly cavity and through the baffles and end caps. Here again, in one embodiment the compressed fluid is comprised substantially of air, or of substantially an inert gas, or it may be comprised substantially of water. In yet another embodiment, the tension members secure the end caps without penetrating the cavity.

In another aspect, the invention relates to a method of supporting a compressive load comprising; providing a column assembly and providing a sealed internal cavity surrounded and defined by an impermeable layer, filling said cavity with one or more fluids under pressure, placing one or more structural layers successively around said impermeable layer, so as to provide structural integrity to the layer immediately within; and placing a compressive load on said column assembly.

In an embodiment of the foregoing aspect, the cavity volume is filled with air, while tension members running along the length of the compressed member securing the end caps to said compressed member.

Other features and advantages of the present invention will become apparent upon examining the following detailed description of an embodiment thereof, taken in conjunction with the attached drawings.

DETAILED DESCRIPTION

To provide an overall understanding of the invention, certain illustrative embodiments will now be described, including apparatus and methods for displaying images. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope hereof.

Figure 1:
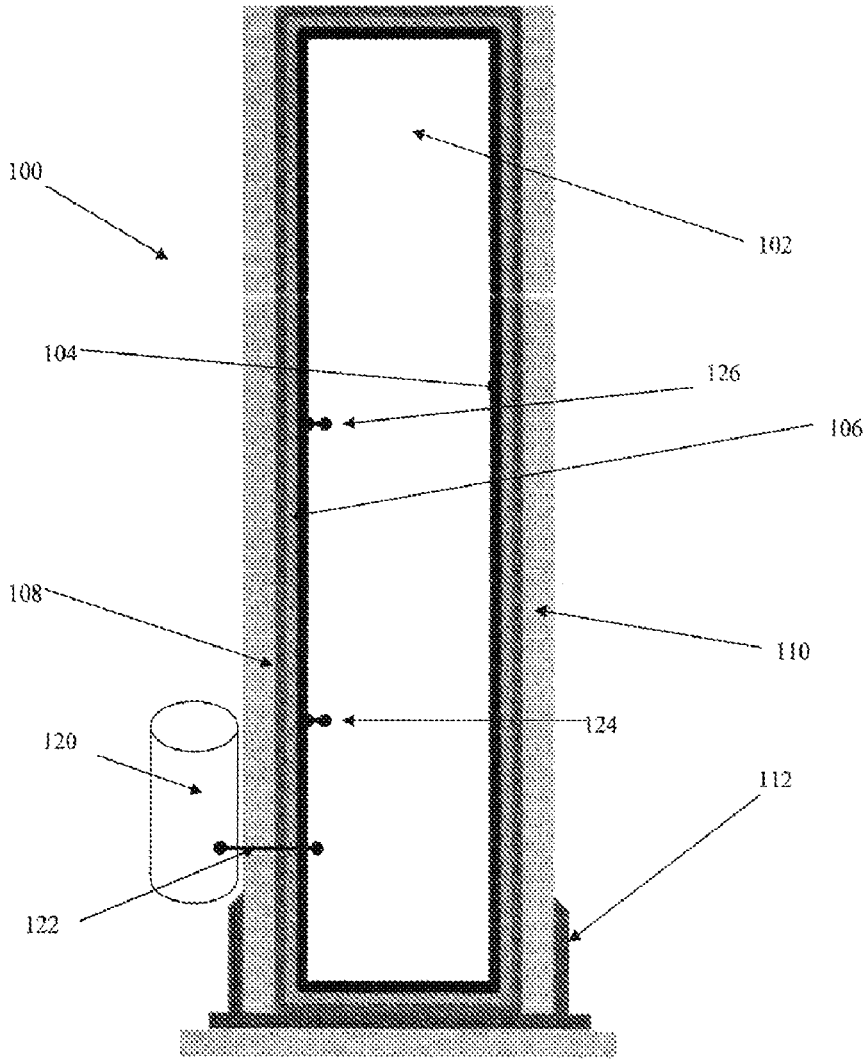
FIG. 1 depicts a side view of a circular column structure assembly, according to an exemplary embodiment of the present invention.
Figure 2:
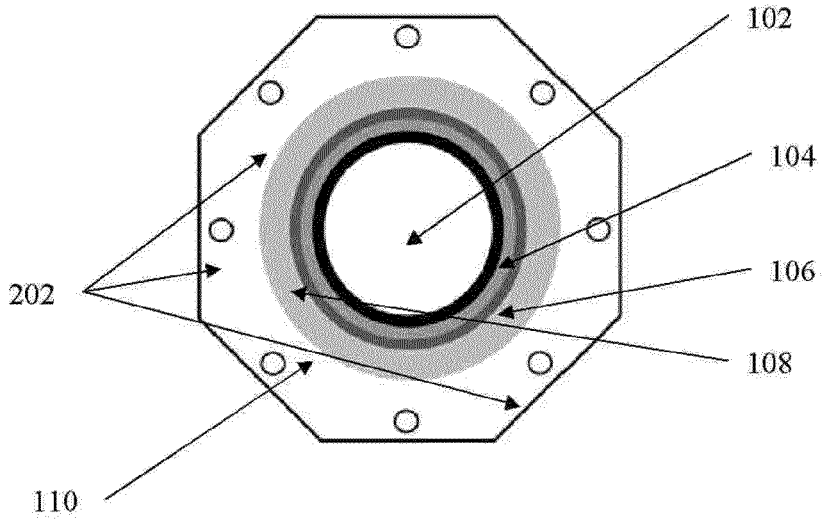
FIG. 2 depicts a top view of a circular column structure assembly, according to an exemplary embodiment of the present invention.

In one embodiment, tensional means may be performed by gravity, by placing the structure in permanent compression. Such is the case where the structural member is going to function as a column, and placing it in permanent compression (due to the payload above the column) causes the column to be in compression. FIGS. 1 and 2 illustrate side and top views of such an illustrative embodiment. In it, a column assembly 100 is comprised of various elements used to construct one or more cavities 102 within it, each cavity containing one or more fluids (be they gases, liquids or combinations thereof).

Note that the use of the term gas or gases is meant to convey the containment within the cavity 102 of one or more gases, used either exclusively, or in combination with others. In most cases, the gas contained within the member body will be air (easiest to supply and maintain). In other embodiments, there may be a need to fill the cavity 102 with a specific gas. For example, when the beam is part of the interior of a clean room, or a nuclear reactor containment building, the situation may require the use of either precisely filtered air, or an inert gas like Neon or Helium.

In an alternate embodiment, the cavity is substantially or completely filled with a liquid. In this fashion, the medium being compresses and monitored is a liquid instead of a gas. In one embodiment, this liquid is water, whereas in alternate embodiments it may be any other suitable liquid.

High pressure inside the cavity 102 acts as a damper, and when a load is placed on the top face, the pressure of said load is transferred through the cavity 102 volume to its walls, supporting the load by the air pressure acting on the composite walls around the cavity 102. The gas presses on the inner member 104, that itself presses on the successive outer layers. In one embodiment, a combined PVC/Sleeve 106/108, is used to sustain the pressure, effectively creating a piston under pressure. The assembly 100 would be quite rigid as long as the external pressure on the top face did not exceed the pressure of the air inside the box.

For optimal pressure distribution, in one embodiment a significant circular cross 200 section is preferred. However, alternate embodiments could be constructed with angular walls, up to and including rectangular shapes.

In one embodiment, the internal wall of the cavity 102 is lined with a pneumatically impermeable layer 104. This may be accomplished by using rubber 104 (either natural or synthetic), or such other pneumatically impermeable material. This impermeable layer provides for the containment of the gases within it, as well for the collection at the bottom of the cavity 102 of any liquids or solids that may form over time, or may have been introduced through the pressure maintenance means.

Along the walls of the cavity 102, pressure, temperature and strain gages sensing means are employed. In one embodiment, the sensing means are comprised of transducers installed to measure the internal pressure and temperature of the cavity chamber 102, and communicate it to the outside. This may be accomplished via a number of well known techniques, such as wirelessly, wired, induction and others. In an alternate embodiment, strain gages are implanted on one or more of the layers, and also connected so as to communicate their readings to a monitoring station.

Pressure sensing means may be comprised of a number of methods similar to those used to monitor vehicle Tire Pressure in Modern Automotive tires, see Matsuzaki et al, "Wireless Monitoring of Automobile Tires For Intelligent Tires", Sensors 2008, ISSN 1424-8220, the totality of which is incorporated herein by reference. As with modern tires in vehicles, an automated system could be implemented which would advise when the conditions at a particular column or member have changed, or become unsafe.

In addition, in locations with significant temperature swings during the day, active pressure control means may be employed, by reducing the amount of air within the cavity 102 during the hot times of the day, and adding air to the cavity 102 during the cooler periods.

Proceeding from the cavity 102 side outwards, one or more pressure and support containment layers are encountered. In one embodiment, a first containment layer 106 of a solid or significantly solid material surrounds the impermeable layer 104. In one embodiment, this first containment layer is comprised of a plastic material such as PVC (Polyvinyl chloride) or such other moldable semi-rigid plastic (PVC is made moldable by the addition of plasticizers). Thus, in one example embodiment, one could specify a Sched 40 PVC (rated at no less than 965 kPa). This solid material layer 106 is here primarily to provide a smooth and even surface against which the impermeable layer 104 "pushes" as its contained envelope of air pressure increases.

In one embodiment, a lubricant may be added between these two layers (or any other two) may be envisioned, in order to reduce any peeling or abrasive friction over time. This lubricant layer may be comprised of Vaseline, Silicone, oil or any other such natural or synthetic friction reducing agent.

In one embodiment, the next layer would be a second containment layer 108 (continuing outward from the cavity 102), which may be comprised of a variety of polymers, such as Fiberglass, fiber-reinforced polymer (FRP), glass-reinforced plastic (GRP)); or Carbon fiber or Graphite reinforced Polymers; or metal; and/or any combination thereof, including such well known materials as Kevlar, Fiberglass, etc. Besides strength, another major reason for this second containment layer 108, would be protection against the environment. Said protection includes both actual environmental factors, particularly light (and its plastic damaging UV components), wind, water, etc., but also human-created factors (vehicle impacts, deranged humans with hammers, bullets, etc.).

In one embodiment, the final or wrapping layer 110 is one made of concrete. This layer may be poured in place, or it may be simply attached as two shells that overlap the column made by layers 104, 106 and 108. As with the second containment layer 108, this wrapping layer 110 would protect the assembly from external factors related to weather and humans. In addition, its construction would allow observers to "feel" that the structure above (be a roof, train track, elevated roadway or whatever) is being held by a traditional, trusted concrete pillar.

In one embodiment, the complete assembly 100 is held in place by a base 112 designed to keep it fixed in space. Said base 112 may be equipped with attachment means 202 for the securing of the complete assembly to another structure. Said means may be comprised of openings for bolts, reinforcement bars (rebar), bolts, or any other mechanical means for attachment.

Alternate embodiments may hold the complete assembly 100 via other construction assemblies, such as abutments, openings, etc. In one embodiment, temperature within the cavity 102 is controlled by placing a significant portion of the assembly 100 deep within the earth surface. This arrangement allows for thermal stability of the gas or liquid within the cavity, as the ground below two or three meters acts as a thermal sink, never allowing conditions to get too cold or too hot. In an alternate embodiment, an insulating layer of a thermally isolated material is placed between any one of the layers of the assembly.

Figure 3:
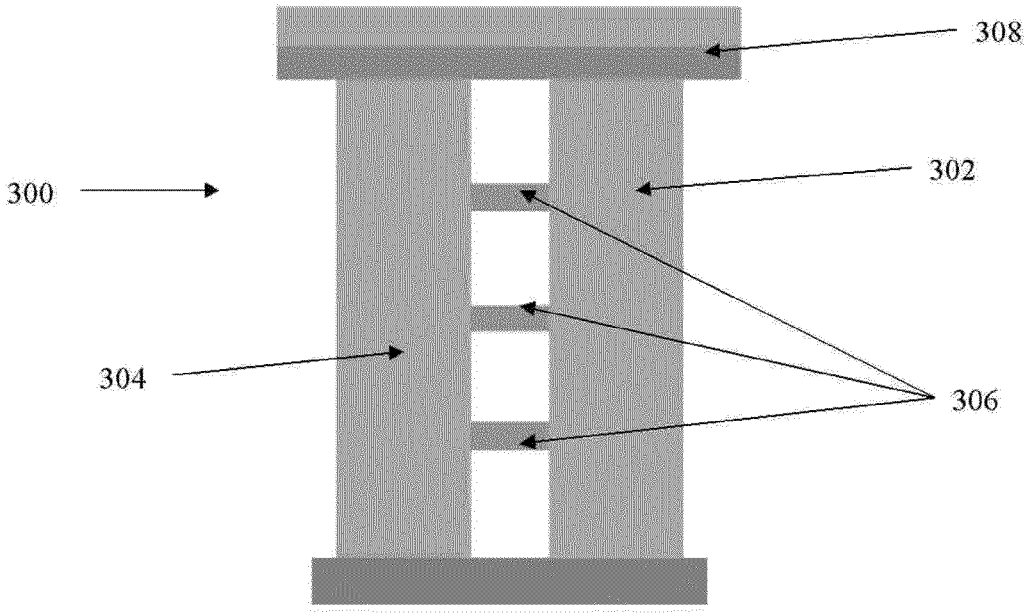
FIG. 3 depicts a side view of a column structure assembly using two cross-linked columns, according to an exemplary embodiment of the present invention.

In one embodiment, two or more of the columns are horizontally coupled or attached together with additional means, in order to provide further securing means (such as cross bracing) and redundancy. As seen in FIG. 3, two (or more) columns (302, 304) may be linked by cross linking members 306. In the illustrative embodiment, these are horizontal members, but in alternate embodiments may be cross-linked members. The cross linking members 306, provide additional stability, as well as a measure of further stability in the event of a failure by either its neighbor column, or an adjoining one placed "up/down the road". In an alternate embodiment, the columns may be linked not only to its members, but also to its neighbors "up/down the road" the direction of travel of the roadway 308 being supported.

To prevent gradual deflation by possible small leaks, each cavity 102 could have a small-diameter opening with a one-way valve. Either manually or automatically, pressure losses would be monitored as described above, and replenished through the opening from either a storage tank or a compressor. When properly built, the cavities 102 should hold their pressure for years, just like car tires.

In the case of a complete failure, accidental damage or any other defect, the assembly may be removed. If necessary, a temporary structure may be assembled, but in cases where three or more columns where used, they may be simply removed and replaced by a new one.

In an alternate embodiment, one or more of the above elements comprising the composite may be obviated. Such is the case when the structural element is completely built of a carbon fiber composite, which may be designed to be impervious to gas molecules escaping across its membranes.

Figure 4A:
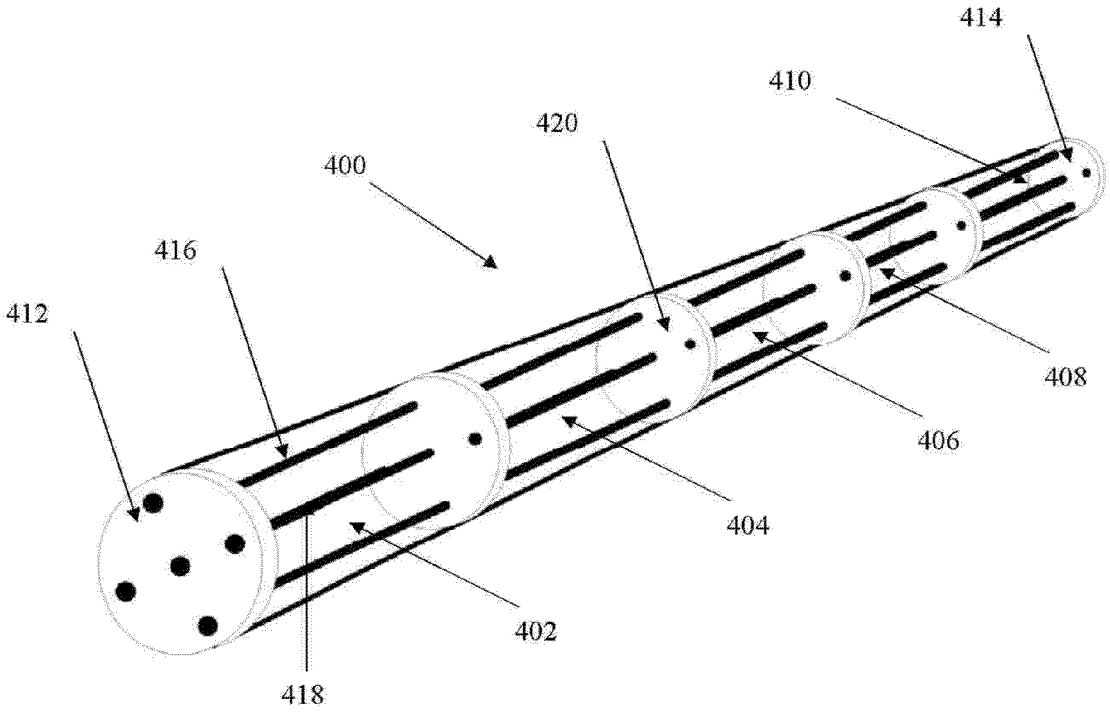
FIGS. 4A and 4B depict beam members for horizontal placement as part of a roadway, according to an exemplary embodiment of the present invention.

In addition to vertical columns as shown in FIGS. 1-3, laterally placed and linked compressed gas building structures may also be used. In one exemplary embodiment, shown in FIGS. 4A and 4B, this is accomplished by linking two or more compressed bodies together, via interior or exterior tension members, or a combination thereof.

In one embodiment, the internal linking described above is accomplished by creating a continuously connected member 400, with a series of impermeable and variably sealed internal chambers (402, 404, 406, 408, 410). As with the column assembly, each chamber is created from a series of layers, beginning with an impermeable one, surrounded by one or more structural layers. Each chamber is internally separated from its neighbor via an internal baffle 420, which may have active or passive linking means for connecting the baffles to each other. Such valves would allow for the controlled flow of gas from one chamber to the next, as well as for the correct placement and tension of the individual tension members 416, 418. The tension members are comprised of one or more cables, filaments, rods, or any other such tensile strong material, which will proceed to provide an un-bending resistance on the assembly. In one embodiment, said tension members travel from one end of the structure to the other, from one end cap to the other, keeping them securely attached to the ends of the connected member 400.

At each end of the connected member 400 is an end cap (412, 414). The end cap is specifically designed to handle the tension force of the one or more cable members (e.g. 416, 418), as well as to create a seal around the circumference of the assembly. In one embodiment (as with the gravity columns described before 100) this may be accomplished via a uni-body construction, rather than by an actual separate cap.

In an alternate embodiment, the end of the assembly 400 may be sealed by actual end caps, designed to be sealed by mechanical, chemical or other such sealing means around their periphery, and using the tensile members (416, 418) running across all baffles (e.g. 420) to keep the cap in place (when using internal cabling). When containing the end caps (412, 414), the cables (416, 418) would exit the chambers at the end (402, 410), the above would require the connecting cables Passing the cables through their surface while retaining a sealed environment is a well understood art, similar to that used daily in penetrating pressured vessels with data and other utility cables.

Figure 4B:
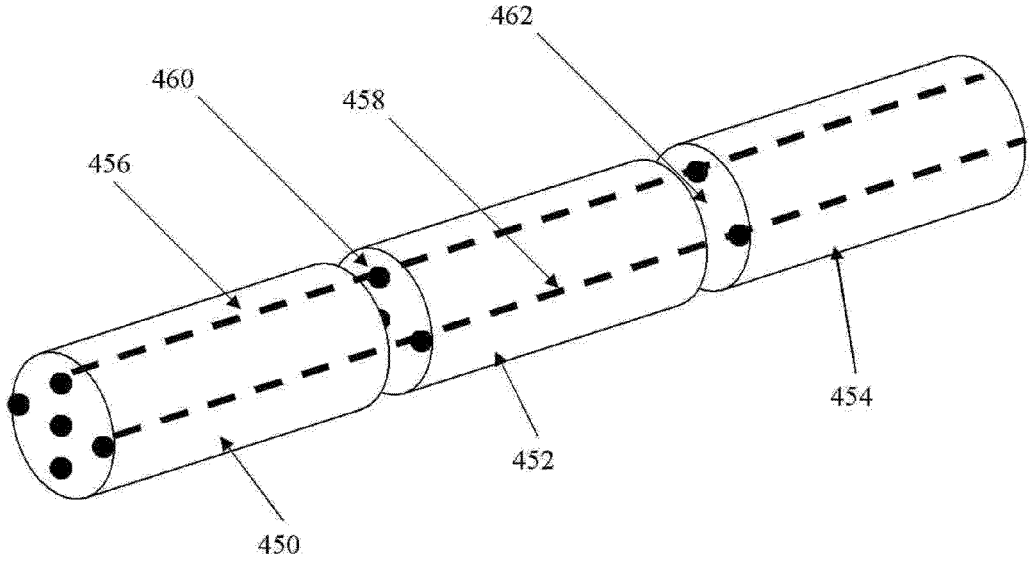

As seen in FIG. 4B, in an alternate embodiment, the assembly may be created by connecting independently chambered columns (450, 452, 454), using internal tension means (456, 458). In an alternate embodiment, the tensioning means may be external. Of course, the gaps (460, 462) would be millimetric. As with steel beams, whether continuously connected chamber or independent ones, in one embodiment the shape of the beam may be slightly curved to account for the expected sag when the device is laid across columns to span a gap. As with their vertical brethren, the chambers would be equipped with pressure sensing and re-supplying means, in order to sense any pressure failure and account for it before any disastrous failure.

Figure 5:
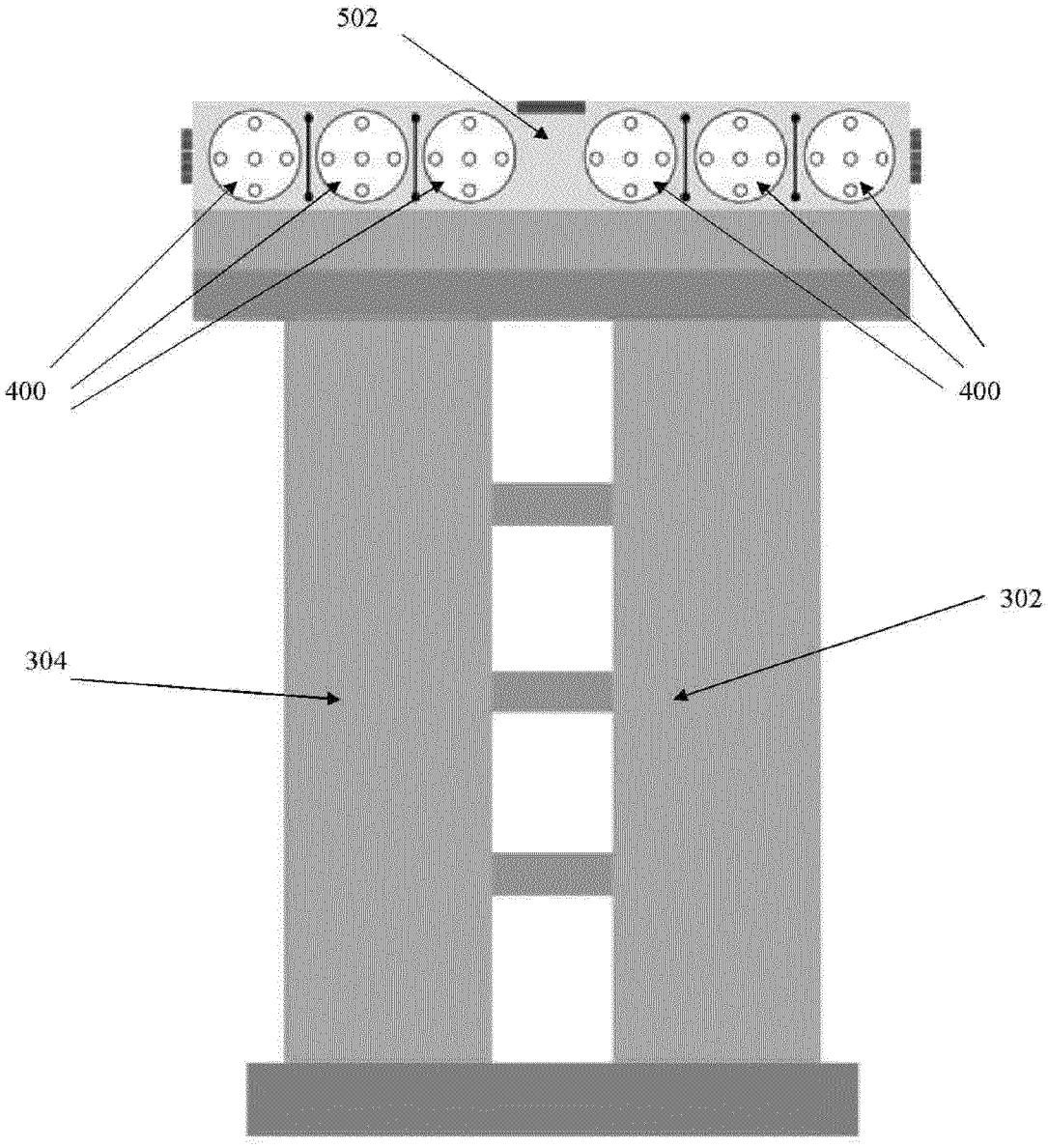
FIGS. 5, 6 and 7 depict schematic views of roadway using beam members according to an exemplary embodiment of the present invention.
Figure 6:
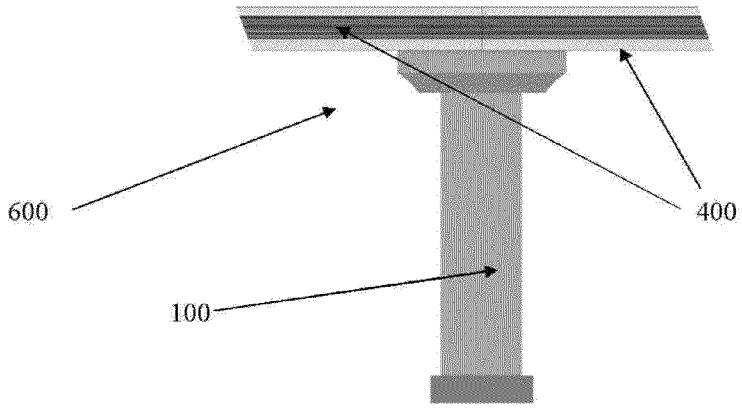
Figure 7:
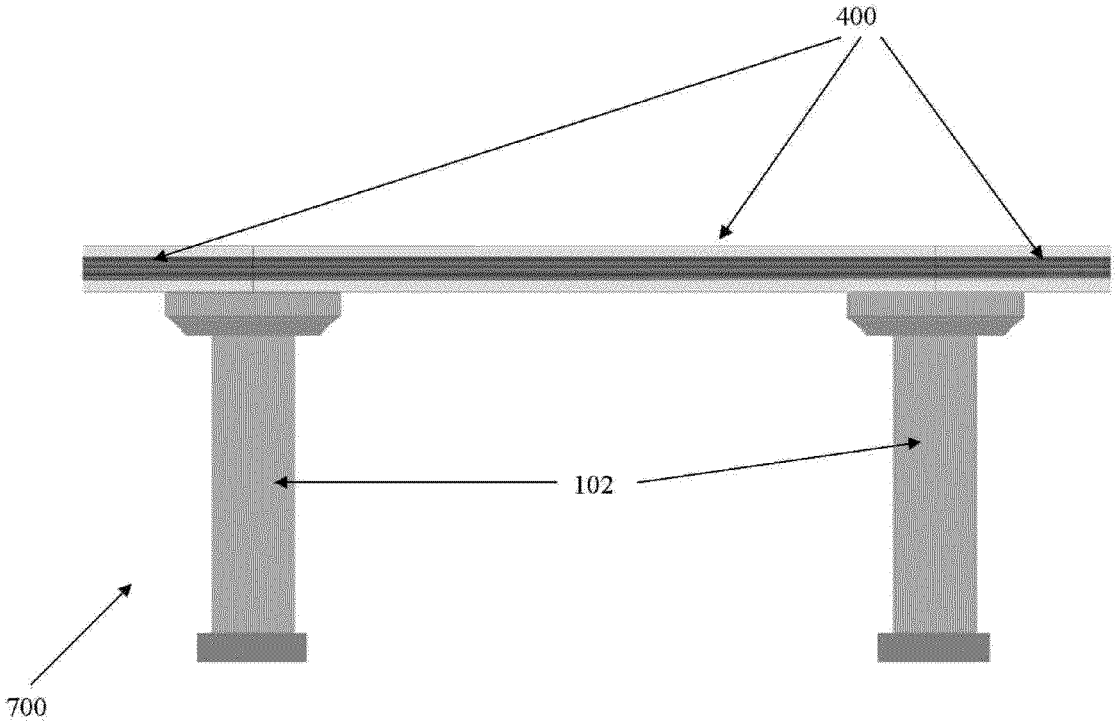

The building of a roadway is better appreciated by looking at the illustrative embodiment shown in FIGS. 5, 6, and 7. One or more horizontally placed beam members 400 are laid side by side, and encased in concrete. In one embodiment, a steel rebar is additionally used to form a frame.

This construction technique is similar to that used today in building concrete beams, but has the additional advantage of being able to produce an assembly 502 which is up to 50 to 75% lighter than a comparable solid one. This is due to the fact that a significant portion of its interior is made of a volume filled with gas (preferably air), the composite container (also lighter than concrete) and concrete. The rigidity of the encased beam(s) 400 provides a stronger assembly than one with simple openings to save weight. To span an opening 600, 700, the assemblies 502 are supported at their ends by the columns 100.

Example 1

To give an idea of the kind of load that can be borne by a column such as the one in FIG. 1, suppose it is constructed in the form of a cylinder that has a diameter of 3 meters (r=1.5 m). Such a surface would have an area A=3.14*1.5**2 or 7.065 meter sq., if the cavity were filled at a pressure of 1,380 kPa, the resulting surface would be able to bear almost 10 metric tons (9.75 to be exact).

Various embodiments and features of the present invention have been described in detail with a certain degree of particularity. The utilities thereof can be appreciated by those skilled in the art. It should be emphasized that the above-described embodiments of the present invention merely describe possible examples of the implementations to set forth a clear understanding of the principles of the invention, and that numerous changes, variations, and modifications can be made to the embodiments described herein without departing from the spirit and scope of principles of the invention. Also, such variations and modifications are intended to be included herein within the scope of the present invention, as set forth in the appended claims. The scope of the present invention is defined by the appended claims, rather than the forgoing description of embodiments. Accordingly, what is desired to be secured by Letters Patent is the invention as defined and differentiated in the following claims, and all equivalents

What is claimed is:

1. A column assembly apparatus for
supporting a compressive load comprising;
a sealed internal cavity surrounded and defined by an impermeable layer;
one or more fluids under pressure within said cavity; and
one or more structural containment layers surrounding said impermeable layer, with at least one of said structural containment layers extending substantially the same length as said impermeable layer, and said containment layer being comprised of a significantly rigid and non-collapsible material of a pre-determined length that is incapable of significantly altering its shape or length so as to provide structural integrity to a layer immediately within it; and a concrete encasement surrounding said containment layers.

2. The column assembly of claim 1 wherein;
the compressed fluid is comprised substantially of air and one of said containment layers is comprised of a Polyvinyl Chloride mix.

3. The column assembly of claim 1 wherein;
the compressed fluid is comprised substantially of an inert gas and one of said containment layers is comprised of a Polyvinyl Chloride mix.

4. The column assembly of claim 1 wherein;
the compressed fluid is comprised substantially of water and one of said containment layers is comprised of a Polyvinyl Chloride mix.

5. The column assembly of claim 2 further comprising;
cavity pressure sensing means.

6. The column assembly of claim 5 further comprising;
cavity temperature sensing means.

7. The column assembly of claim 5 further comprising;
cavity pressure adjusting means.

8. The column assembly of claim 7 further comprising;
a mounting base.

9. The column assembly of claim 1 further comprising;
one of said containment layers is comprised of a Polyvinyl Chloride mix, and
tension members running along the length of the compressed member securing the end caps to said compressed member.

10. The column assembly of claim 9 further comprising;
one or more internal baffles separating the cavity into connected portions.

11. The column assembly of claim 10 wherein;
said tension members run within the cavity and through the baffles and end caps.

12. The column assembly of claim 11 wherein;
the compressed fluid is comprised substantially of air.

13. The column assembly of claim 11 wherein;
the compressed fluid is comprised substantially of an inert gas.

14. A method for supporting a compressive load comprising; providing a column assembly comprising;
providing a sealed internal cavity surrounded and defined by an impermeable layer;
filling said cavity with air under pressure;
placing one or more structural containment layers surrounding said impermeable layer, with at least one of said structural containment layer extending substantially the same length as said impermeable layer, and said containment layer being comprised of a significantly rigid and non-collapsible material of a pre-determined length that is incapable of significantly altering its shape or length so as to provide structural integrity to the layer immediately within it, one of said containment layers being comprised of a Polyvinyl chloride mix;
providing tension members running along the length of the column assembly securing end caps to said column assembly; and
placing a compressive load on said column assembly.

15. A column assembly apparatus for
supporting a compressive load comprising;
one or more sealed internal cavity surrounded and defined by an impermeable layer, each said cavity containing one or more fluids under pressure within it;
one or more structural containment layers surrounding said impermeable layer, with at least one of said structural containment layers extending substantially the same length as said impermeable layer, and said containment layer being comprised of a significantly rigid and non-collapsible material of a pre-determined length that is incapable of significantly altering its shape or length so as to provide structural integrity to a layer immediately within it; tension members running along the length of the column assembly securing end caps to said column assembly, with one or more internal baffles separating the cavity into connected portions; and a concrete encasement surrounding said cavity.

* * * * *